US008376757B2

(12) United States Patent
Yamamoto et al.

(10) Patent No.: US 8,376,757 B2
(45) Date of Patent: Feb. 19, 2013

(54) SLIP RING DEVICE

(75) Inventors: Atsushi Yamamoto, Gumma (JP); Kaoru Endo, Gumma (JP)

(73) Assignee: Nidec Servo Corporation, Gumma (JP)

( * ) Notice: Subject to any disclaimer, the term of this patent is extended or adjusted under 35 U.S.C. 154(b) by 0 days.

(21) Appl. No.: 13/288,075

(22) Filed: Nov. 3, 2011

(65) Prior Publication Data

US 2012/0115335 A1 May 10, 2012

(30) Foreign Application Priority Data

Nov. 4, 2010 (JP) ..... 2010-247053

(51) Int. Cl.
*H01R 39/00* (2006.01)

(52) U.S. Cl. ..... 439/25; 439/18

(58) Field of Classification Search ..... 439/13, 439/18–21, 23–26
See application file for complete search history.

(56) References Cited

U.S. PATENT DOCUMENTS

| | | | | |
|---|---|---|---|---|
| 7,481,655 | B2 * | 1/2009 | Horst et al. | 439/24 |
| 7,559,767 | B2 * | 7/2009 | Coleman et al. | 439/13 |
| 7,601,006 | B2 * | 10/2009 | Christoffersen | 439/32 |
| 8,025,506 | B2 * | 9/2011 | Cairns | 439/24 |
| 8,167,622 | B2 * | 5/2012 | Zhou | 439/21 |

FOREIGN PATENT DOCUMENTS

| | | | |
|---|---|---|---|
| JP | 2003-116249 | A | 4/2003 |
| JP | 2005-278071 | A | 10/2005 |

* cited by examiner

*Primary Examiner* — Khiem Nguyen
(74) *Attorney, Agent, or Firm* — Keating & Bennett, LLP

(57) ABSTRACT

A slip ring device includes a hollow pipe-shaped shaft rotatably supported inside a tubular body of a main case through a bearing and an electricity-collecting body integrally and concentrically provided in the shaft. The electricity-collecting body preferably includes a plurality of electricity-collecting rings and a plurality of insulating rings alternately layered with one another. The slip ring device further includes a plurality of brushes held by the main case and tip end portions making sliding contact with outer circumferential surfaces of the electricity-collecting rings and a plurality of lead lines introduced into the shaft. The lead lines include tip end portions electrically connected to the respective electricity-collecting rings. Two or more of the lead lines include shielded lines.

9 Claims, 4 Drawing Sheets

SLIP RING DEVICE

BACKGROUND OF THE INVENTION

1. Field of the Invention

The present invention relates to a slip ring device and more specifically to a slip ring device preferably for use in transmitting signals in a mechanism including a swing unit, such as, for example, a monitoring camera or a robot mechanism.

2. Description of the Related Art

A conventional slip ring device extensively used in flexing portions or rotating portions such as joint portions of an industrial robot can maintain connection and electric conduction between a fixed-side wiring line and a rotating-side wiring line at all times regardless of continuous rotation or reverse rotation. The slip ring device is designed to avoid disconnection of a wiring line otherwise caused by complex layout or bending fatigue. More specifically, as shown in FIGS. 11 and 12 of Japanese Patent Application Publication No. 2003-116249, a known slip ring device includes a rotating shaft unit having a rotating shaft and a plurality of electricity-collecting rings fixed to the rotating shaft and a fixed unit having a case and electrically conductive brushes and terminals, both of which are connected to the case. Lead lines connected to the electricity-collecting rings are led out to the outside through an insertion bore of the rotating shaft. The electrically conductive brushes connected to the terminals of the fixed unit are kept in sliding contact with the electricity-collecting rings at all times, thereby electrically interconnecting the shaft-side lead lines and the case-side terminals.

In the meantime, a monitoring camera is used as an image signal input unit in a warning system for crime and disaster prevention. A slip ring is arranged on a support base for rotatably supporting the monitoring camera, so that signals can be transmitted between the monitoring camera and the support base through the slip ring. For instance, Japanese Patent Application Publication No. 2005-278071 discloses a known slip ring coupling structure for a monitoring camera and a structure for rotatably and concentrically coupling a first rotating shaft within a slip ring attached to a base plate with a second rotating shaft fixed to a camera support base.

In recent years, due to the demand for an increased image quality, a high-definition monitoring camera is available in a monitoring camera market. In the state-of-the-art monitoring cameras, image information of 200,000 to 400,000 pixels is transmitted at a transmitting speed of about 100 Mbps. In the high-definition monitoring camera of the kind stated above, there is a need to rapidly transmit high-definition image data of 1,000,000 pixels or more, or full-high-definition image data of 2,000,000 pixels or more, at a transmitting speed of about 1 Gbps or more. The conventional slip ring device mentioned above has a structure in which the lead lines are just electrically connected to the brushes and the electricity-collecting rings making sliding contact with each other at all times. Three signal transmission routes, i.e., a lead line route, a slip ring route and a lead line route, are just serially connected to one another with no consideration given to impedance consistency. Therefore, high-speed high-frequency signals such as image signals of a high-definition camera are reflected in the joints of the signal transmission routes and thus are not smoothly transmitted through the signal transmission routes. This leads to increased signal attenuation and reduced reliability.

SUMMARY OF THE INVENTION

Preferred embodiments of the present invention provide a slip ring device that can be used in high-speed transmission of signals of a high-definition monitoring camera or a full-high-definition monitoring camera.

In accordance with a preferred embodiment of the present invention, a slip ring device preferably includes a hollow pipe-shaped shaft rotatably supported inside a tubular body of a main case through a bearing; an electricity-collecting body concentrically provided on the shaft, the electricity-collecting body including a plurality of electricity-collecting rings and a plurality of insulating rings alternately layered with one another; a plurality of brushes provided in a corresponding relationship with the electricity-collecting rings, the brushes including base portions held by the main case and tip end portions arranged to make sliding contact with outer circumferential surfaces of the electricity-collecting rings; and a plurality of lead lines introduced into the shaft, the lead lines including tip end portions electrically connected to the respective electricity-collecting rings, the lead lines including two or more shielded lines.

Two or more of the lead lines electrically connected to the electricity-collecting rings of the electricity-collecting body include twisted-pair lines (preferably including shielding). This makes it possible to make the signals transmitted through the lead lines less susceptible to noises, thereby reducing the amount of radiating noises. If the impedance of the twisted-pair lines is matched with the impedance of slip rings as close as possible, it is possible to reduce reflection of signals caused by the mismatching of impedances and to reduce degradation of signals. As a result of this specific arrangement, it becomes possible to transmit high-speed high-frequency signals, such as, for example, image signals of a high-definition camera. Accordingly, the slip ring device can be included in, for example, a high-definition monitoring camera or other suitable apparatus. The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A slip ring device according to preferred embodiments of the present invention will now be described with reference to the accompanying drawings.

Figure 1:
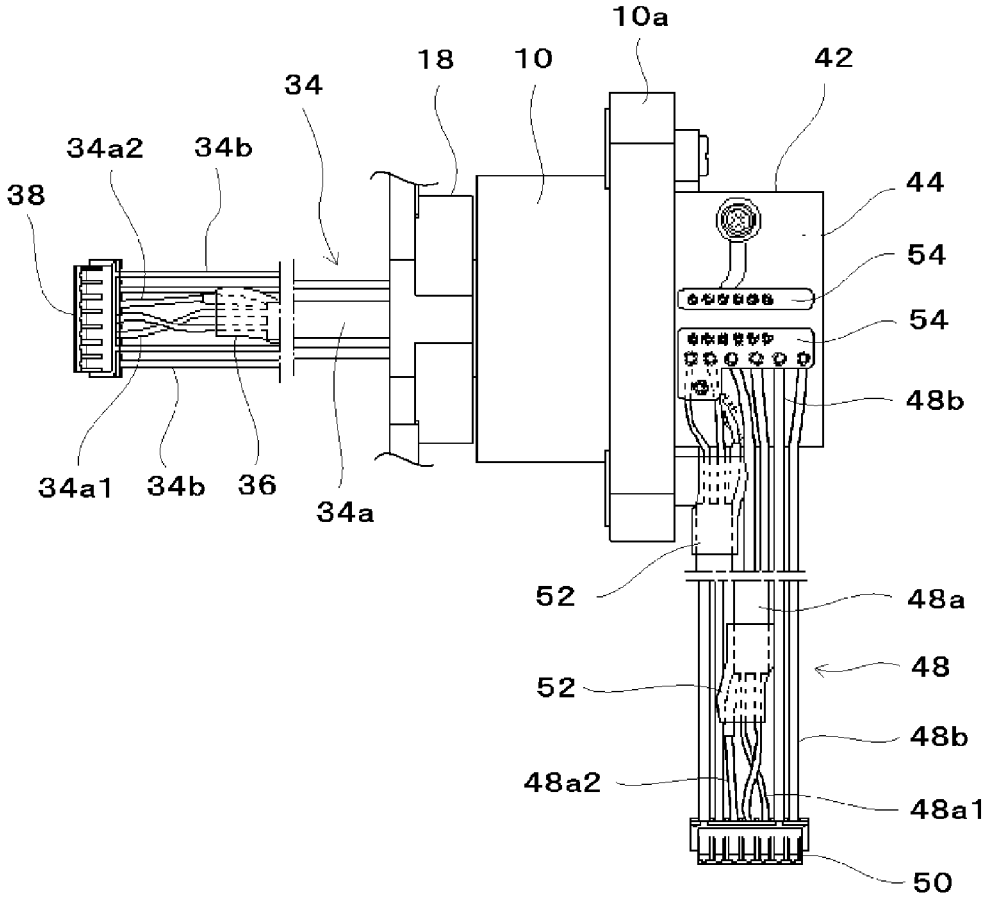
FIG. 1 is a plan view showing a slip ring device according to a preferred embodiment of the present invention.
Figure 2:
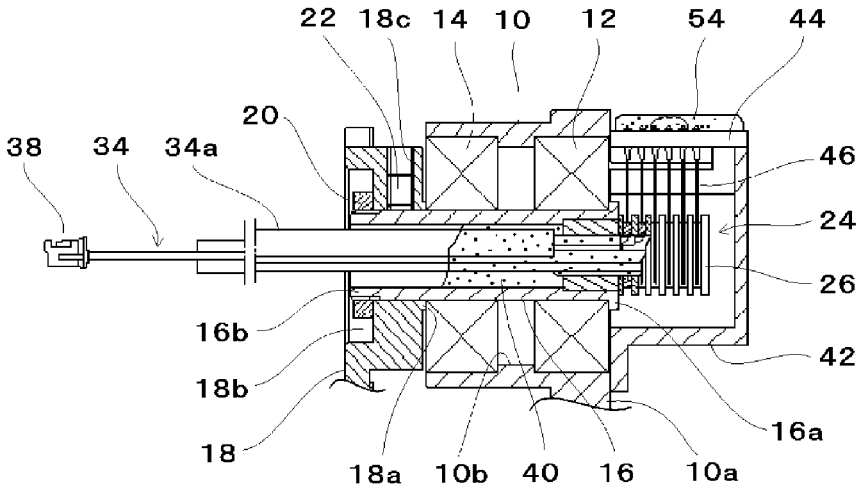
FIG. 2 is a sectional view of the slip ring device shown in FIG. 1.

FIGS. 1 and 2 show the overall configuration of a slip ring device. A cylindrical pipe-shaped shaft 16 is rotatably supported inside a tubular body 10 of a main case through bearings 12 and 14, which are preferably defined by a pair of, for example, ball bearings. An attachment flange 10*a* arranged to permit attachment of the slip ring device is provided at the outer circumference of one end portion of the tubular body 10 as a single monolithic piece. An annular positioning shoulder portion 10*b* is provided in a middle area of an inner circumferential surface of the tubular body 10 so as to protrude radially inwards. The bearings 12 and 14 are preferably mounted to the tubular body 10 with the end surfaces of outer races thereof brought into contact with the annular shoulder portion 10*b*.

An annular flange portion 16*a* is provided at one end portion of the shaft 16 to make contact with the end surface of an inner race of one bearing 12 from one axial end of the shaft 16. A thread portion 16*b* is defined on the outer circumferential surface of the other end of the shaft 16. From the other end side of the shaft 1*b*, a yoke 18 is fitted to the shaft 16, and a nut 20 is threadedly coupled to the thread portion 16*b* of the shaft 16. Thus, a ring-shaped protrusion 18*a* protruding from the central area of the yoke 18 presses an inner race of the other bearing 14 at the axial outer side, thereby applying a pre-compression force to the bearings 12 and 14 arranged between the tubular body 10 and the shaft 16. As a result, the shaft 16 is rotatably and stably supported with respect to the main case with no likelihood of looseness.

The yoke 18 is provided with a recess portion 18*b* at the other side thereof. The nut 20, when tightened, is accommodated within the recess portion 18*b* and is prevented from protruding beyond the end surface of the yoke 18. The yoke 18 has a thread hole 18*c* radially extending therethrough. A stopper screw 22 is threadedly fastened to the thread hole 18*c* so that the end surface of the stopper screw 22 can be pressed against the shaft 16. Thus, the yoke 18 is fixed to the shaft 16. In this manner, the tubular body 10 of the main case and the shaft 16 are rotatably coupled with each other.

Figure 3:
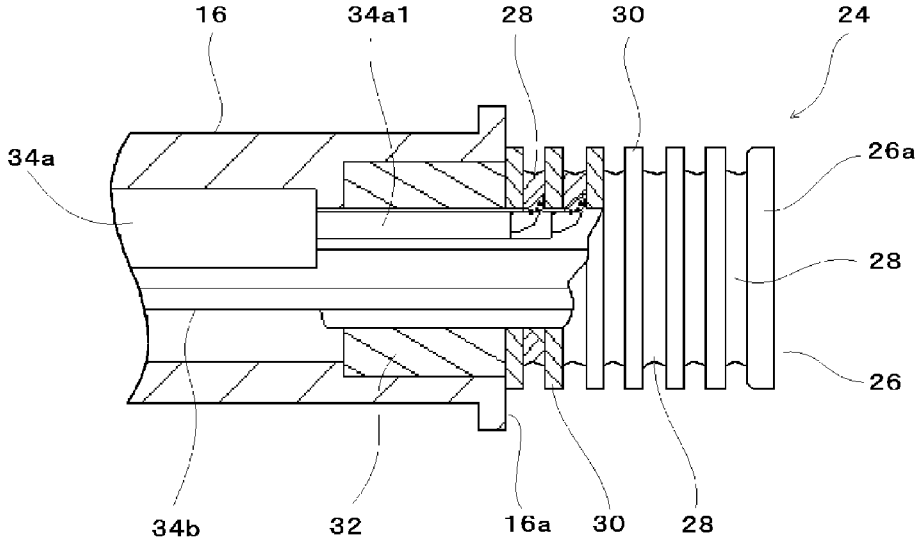
FIG. 3 is a partial sectional view illustrating the details of an electricity-collecting body of the slip ring device shown in FIG. 1.
Figure 5:
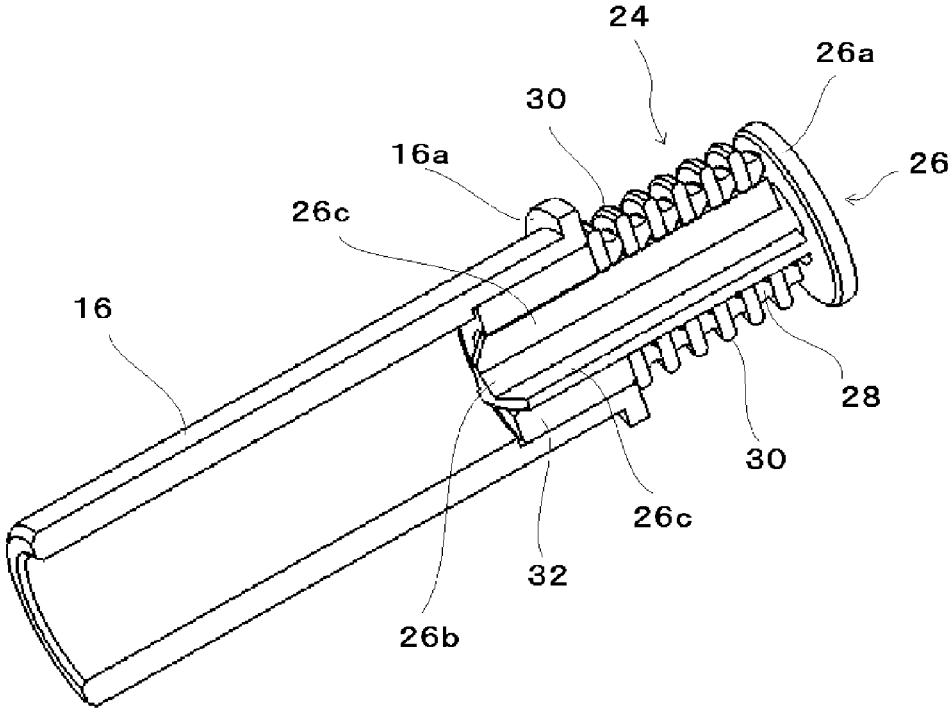
FIG. 5 is a partially cut-away perspective view showing a shaft and the electricity-collecting body of the slip ring device shown in FIG. 1.
Figure 6:
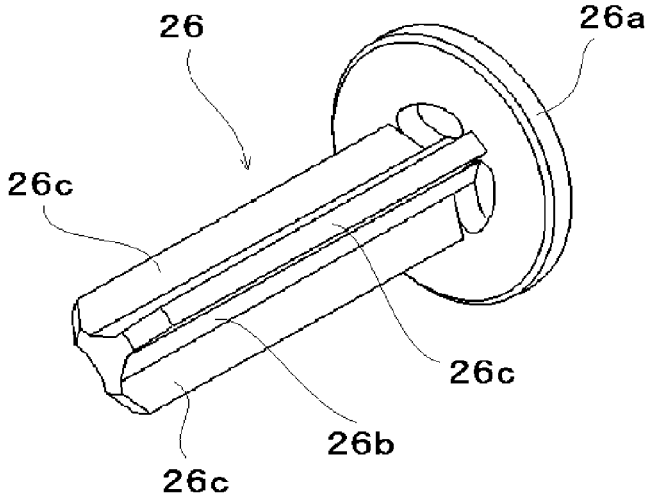
FIG. 6 is a perspective view showing a holder of the slip ring device shown in FIG. 1.

An electricity-collecting body 24 is provided at one end of the shaft 16 to protrude from the shaft 16. As shown in FIGS. 3 and 5, the electricity-collecting body 24 preferably includes an insulating holder 26, a plurality of annular electricity-collecting rings 28, and a plurality of annular insulating rings 30. The holder 26 is preferably provided by, for example, an insulating resin molding. As can be seen in FIG. 6, the holder 26 preferably includes a substantially flat disc-shaped end plate 26*a*, a shaft portion 26*b* extending upright from the center of one surface of the end plate 26*a*, and three axially-extending rib plates 26*c* provided on the outer circumferential surface of the shaft portion 26*b*. The rib plates 26*c* preferably have a radial shape and are spaced at a regular or substantially regular interval in the circumferential direction. The radial tip ends of the respective rib plates 26*c* are positioned on a specified imaginary circle about the shaft portion 26*b*. The annular electricity-collecting rings 28 and the annular insulating rings 30 preferably have an annular shape and an inner diameter substantially equal to the diameter of the specified imaginary circle. The annular insulating rings 30 preferably have an outer diameter equal or substantially equal to the outer diameter of the end plate 26*a*. The annular electricity-collecting rings 28 have an outer diameter smaller than the outer diameter of the end plate 26*a*.

The rib plates 26*c* of the holder 26 are inserted through the bores of the electricity-collecting rings 28 and the insulating rings 30. More specifically, six electricity-collecting rings 28 and six insulating rings 30 are alternately layered from the end plate 26*a*. A cylindrical bush 32 is preferably fitted to the other end portion of the holder 26. Thus, the electricity-collecting rings 28 and the insulating rings 30 are interposed between the end plate 26*a* and the bush 32 in a layered state, thereby defining the electricity-collecting body 24. When the electricity-collecting body 24 is in an assembled state, the electricity-collecting rings 28, which are smaller in diameter than the end plate 26*a* and the insulating rings 30, are positioned between the end plate 26*a* and the respective insulating rings 30. A plurality of brushes (to be described in detail later) makes sliding contact with the outer circumferential surfaces of the respective electricity-collecting rings 28 under a suitable contact pressure. At this time, the brushes are kept in position by the end plate 26*a* and the respective insulating rings 30 without axially moving out of contact with the electricity-collecting rings 28. The electricity-collecting body 24 is securely fixed to the shaft 16 by fitting the bush 32 to the opening of one end portion of the shaft 16.

A lead line group 34 including a plurality of lead lines defining a first transmission route is connected to the respective electricity-collecting rings 28 of the electricity-collecting body 24. More specifically, conical surfaces are defined in the inner circumferences of the respective electricity-collecting rings 28. The end portions of core wires of the lead lines are electrically connected to the conical surfaces of the respective electricity-collecting rings 28 preferably by, for example, laser welding, soldering, etc. The lead lines connected to the respective electricity-collecting rings 28 pass between the respective rib plates 26*c* and extend through the shaft 16 to a location outside the shaft 16.

By this arrangement, the two electricity-collecting rings 28 arranged closer to the base portion (more specifically, closer to the bush 32) of the electricity-collecting body 24 are preferably arranged to be used for high-frequency signals. The remaining four electricity-collecting rings 28 are preferably arranged to be used for power supply, ground, and two control signals. In the present preferred embodiment, twisted-pair lead lines 34*a* preferably including shielding and core wires covered with an insulating layer are connected to the two electricity-collecting rings 28 preferably arranged to be used for high-frequency signals. Coated lead lines 34*b* are connected to the remaining electricity-collecting rings 28. The lead line group extending outwards from the shaft 16 is connected to a connector 38. Two signal lines 34*a*1 of the shielded lead lines 34*a* are twisted and connected to the connector 38. A shielded line 34*a*2 of the shielded lead lines 34*a* is connected to a ground lead line 34*b* within a receiver circuit of a monitoring camera to be connected to the connector 38. In the end portions of the shielded lead lines 34*a*, the signal lines 34*a*1 and the shielded line 34*a*2 are preferably secured to one another through, for example, a heat-shrinkable tube 36.

In this regard, when installing the electricity-collecting body 24 within the shaft 16, the rib plates 26*c* of the holder 26 are not directly fitted into the shaft 16. Instead, the holder 26 is fitted into the shaft 16 through the bush 32 which is fitted to the rib plates 26*c*. For that reason, the inner diameter of the shaft 16 is increased with respect to the size of the bush 32. Accordingly, the shielded lead lines 34*a*, which are relatively bulky, can be used without problems as the lead line group 34 inserted into the shaft 16. An insulating adhesive agent 40 is preferably filled into the shaft 16 to substantially fix the lead line group 34 within the shaft 16. Therefore, despite the relative movement of the fixed portion and the movable portion of the slip ring device, it is possible to prevent the occurrence of an electrical disconnection or a poor electrical connection which may otherwise be caused by the vibration of the lead line group 34.

Figure 4:
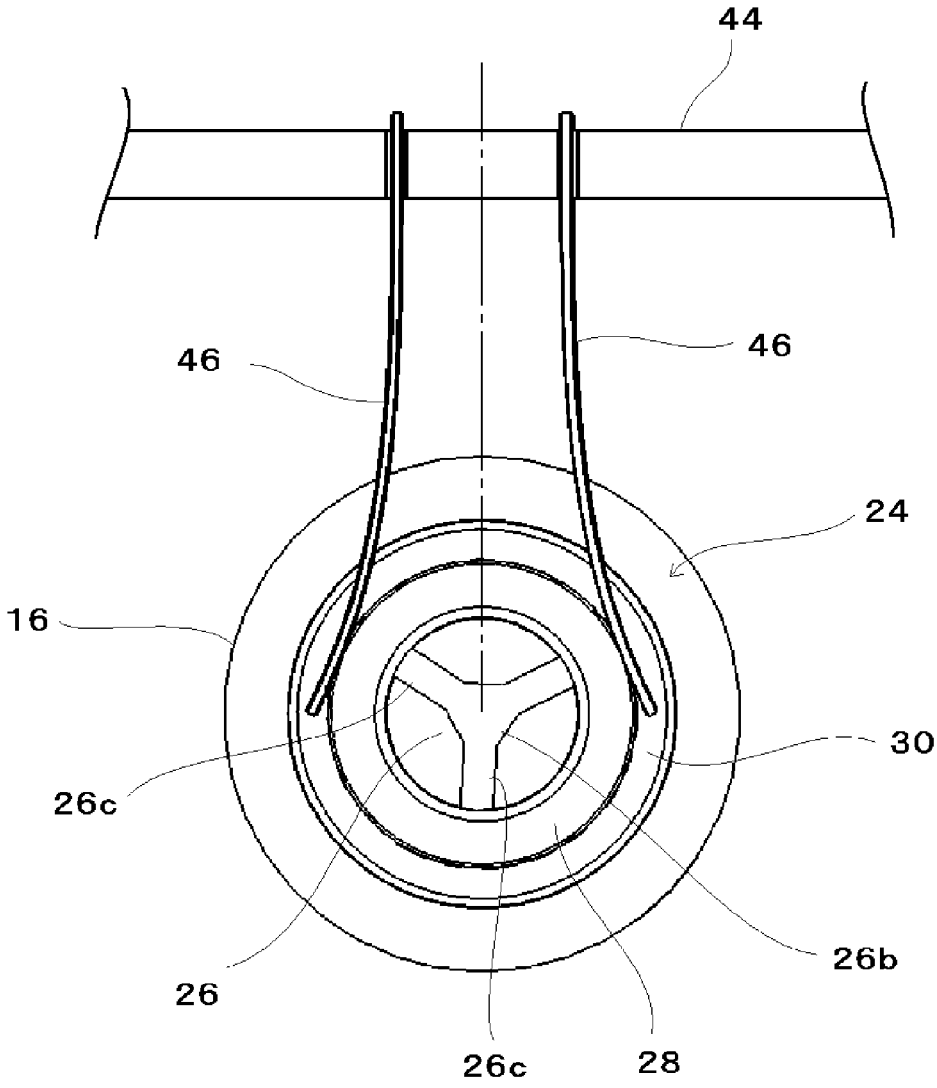
FIG. 4 is a partial side view depicting the relationship between the electricity-collecting body and a brush of the slip ring device shown in FIG. 1.

A cover member 42 arranged to cover the electricity-collecting body 24 protruding from one end of the shaft 16 is provided at one end side of the tubular body 10 of the main case. The tubular body 10 and the cover member 42 preferably define the main case. A portion of the cover member 42 is defined by a circuit board 44 arranged orthogonal or substantially orthogonal to the plane extending across the axis of the electricity-collecting body 24. Pairs of the brushes 46 arranged to mate with the respective electricity-collecting rings 28 of the electricity-collecting body 24 are embedded in the circuit board 44 and are axially arranged along the arrangement direction of the electricity-collecting rings 28. More specifically, as shown in FIG. 4, each pair of the brushes 46 corresponding to each of the electricity-collecting rings 28 is arranged in a symmetrical or substantially symmetrical relationship with respect to a plane indicated by a single-dot chain line in FIG. 4 extending perpendicularly or substantially perpendicularly to the circuit board 44 and including the axis of the electricity-collecting body 24. The base portions of each pair of the brushes 46 are inserted into the circuit board 44 and electrically connected to the circuit patterns of the circuit board 44 preferably by, for example, soldering. Thus, the respective brushes 46 are mechanically held by the circuit board 44. The tip end portions of the respective brushes 46 make contact with the outer circumferential surfaces of the electricity-collecting rings 28 in an elastically deformable manner.

In the circuit board 44, circuit patterns arranged to interconnect each pair of brushes 46 and to connect external connection terminals corresponding thereto are provided with respect to each pair of the brushes 46. As shown in FIG. 1, lead lines of a lead line group 48 defining a second transmission route are electrically connected to the external connection terminals. In other words, twisted-pair lead lines 48*a* including a shielding function and including core wires covered with an insulating layer are connected to the external connection terminals corresponding to the brushes 46 that make sliding contact with the two electricity-collecting rings 28 preferably arranged to be used for high-frequency signals. Coated lead lines 48*b* are connected to the external connection terminals corresponding to the brushes 46 that make sliding contact with the remaining electricity-collecting rings 28. The lead line group 48 including these lead lines is connected to the connector 50. Two signal lines 48*a*1 of the shielded lead lines 48*a* are twisted and connected to the connector 50. A shielded line 48*a*2 of the shielded lead lines 48*a* is connected to a ground lead line 34*b* within a receiver circuit of a processing unit to be connected to the connector 50. In the end portions of the shielded lead lines 48*a*, the signal lines 48*a*1 and the shielded line 48*a*2 are preferably connected together by, for example, a heat-shrinkable tube 52. The soldered portions of the end portions of the brushes 46 in the circuit board 44 and the soldered portions of the external connection terminals with the lead lines are encapsulated by an insulating adhesive 54 agent to maintain contact reliability.

Where the slip ring device configured as described above is applied to, e.g., a monitoring camera, the tubular body 10 of the main case is preferably fixed to a base plate arranged to permit attachment of the monitoring camera by use of the attachment flange 10*a* with the axes of the tubular body 10 and the shaft 16 oriented in the vertical direction. The monitoring camera is attached to the yoke 18 in a hanging state. Thus, the monitoring camera is rotatably supported through the slip ring device to rotate with respect to the base plate. The connector of the lead line group 34 is connected to the monitoring camera, while the connector 50 of the lead line group 48 is connected to a processing unit arranged to control the monitoring camera and process the image information. The electric power and the control signals are supplied from the processing unit to the monitoring camera through the slip ring device. The image information is transmitted from the monitoring camera to the processing unit through the slip ring device.

The image signals from the monitoring camera are transmitted to the processing unit through the transmission route defined by the lead line group 34, the transmission route defined by the slip ring device in which the electricity-collecting rings 28 and the brushes 46 make sliding contact with each other, and the transmission route defined by the lead line group 48. In the case of high-speed high-frequency signals, such as, for example, image signals of a high-definition camera, the signals will be reflected in the joint portions of the respective transmission routes unless the impedances of the respective transmission routes are matched or substantially matched with one another. This leads to poor transmission and increased attenuation of the signals.

In the slip ring device where the electricity-collecting rings 28 and the brushes 46 make sliding contact with each other, the attenuation of the signals during the transmission of the high-frequency signals can be reduced or substantially reduced if the distance between the electricity-collecting rings 28 or the dimension of the brushes 46 is preferably smaller. In view of this, the distance between the electricity-collecting rings 28 or the dimension of the brushes is preferably kept as small as possible. Moreover, if the electricity-collecting body 24 is reduced in size and if the size of the shaft 16 is reduced in proportion thereto, it becomes difficult to insert the lead lines, particularly shielded lead lines, into the shaft 16. However, the use of the bush 32 in the electricity-collecting body 24 having a reduced size makes it possible to fit the electricity-collecting body 24 to the shaft 16 having a specified inner diameter. Accordingly, the lead line group 34 including the shielded lead lines 34*a* can be applied to the slip ring device.

In the preferred embodiment described above, the lead line group 34 including the shielded lead lines 34*a* is preferably included in the transmission route between the monitoring camera and the slip ring device. The lead line group 48 including the shielded lead lines 48*a* is included in the transmission route between the slip ring device and the external processing unit. The impedance of the slip ring device is matched with the impedances of these transmission routes. As a result, the attenuation of the high-speed high-frequency image signals of the monitoring camera in the respective transmission routes and the joint portions thereof is avoided or substantially alleviated. This makes it possible to transmit the image signals at an increased speed.

In the preferred embodiment described above, the electricity-collecting rings 28 for high-frequency signals are preferably arranged in the base portion of the electricity-collecting body 24. This is to shorten the lead line length as far as possible and to secure the signal transmission reliability.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A slip ring device, comprising:

a hollow pipe-shaped shaft rotatably supported inside a tubular body of a main case through a bearing;

an electricity-collecting body concentrically provided to the shaft, the electricity-collecting body including a plurality of electricity-collecting rings and a plurality of insulating rings alternately layered with one another;

a plurality of brushes provided in a corresponding relationship with the plurality of electricity-collecting rings, the plurality of brushes including base portions arranged to be held by the main case and tip end portions arranged to make sliding contact with outer circumferential surfaces of the plurality of electricity-collecting rings; and a plurality of lead lines introduced into the shaft, the plurality of lead lines including tip end portions electrically connected to respective ones of the plurality of electricity-collecting rings, the plurality of lead lines including at least two shielded lines.

2. The device of claim 1, wherein one of the plurality of lead lines is a ground line connected to one of the shielded lines.

3. The device of claim 1, wherein an adhesive agent is filled into, and solidified within, the shaft to hold the lead lines in place.

4. The device of claim 1, wherein the electricity-collecting body is provided to a tip end portion of the shaft to protrude from the shaft, the shielded lines including a signal line connected to one of the plurality of electricity-collecting rings positioned near the shaft.

5. The device of claim 2, wherein the electricity-collecting body is provided to a tip end portion of the shaft to protrude from the shaft, the shielded lines including a signal line connected to one of the plurality of electricity-collecting rings positioned near the shaft.

6. The device of claim 4, wherein the electricity-collecting body includes an insulating holder, the insulating holder including a plurality of partition plates arranged in a radial pattern and an end plate provided at a first longitudinal end of the insulating holder, the plurality of electricity-collecting rings and the plurality of insulating rings alternately layered from the end plate toward a second longitudinal end of the insulating holder fitted to the tip end portion of the shaft.

7. The device of claim 5, wherein the electricity-collecting body includes an insulating holder, the insulating holder including a plurality of partition plates arranged in a radial pattern and an end plate provided at a first longitudinal end of the insulating holder, the plurality of electricity-collecting rings and the plurality of insulating rings alternately layered with one another from the end plate toward a second longitudinal end of the insulating holder fitted to the tip end portion of the shaft.

8. The device of claim 6, wherein the second longitudinal end of the insulating holder is fitted to the tip end portion of the shaft through a cylindrical bush, the insulating holder having an outer diameter smaller than an inner diameter of the shaft.

9. The device of claim 7, wherein the second longitudinal end of the insulating holder is fitted to the tip end portion of the shaft through a cylindrical bush, the insulating holder having an outer diameter smaller than an inner diameter of the shaft.

* * * * *